US008082718B2

(12) United States Patent
Esbaum

(10) Patent No.: US 8,082,718 B2
(45) Date of Patent: Dec. 27, 2011

(54) BOOKSHELF BUILDING PANEL AND METHOD OF CONSTRUCTION

(76) Inventor: Tyler Jon Esbaum, Dixon, IA (US)

( * ) Notice: Subject to any disclaimer, the term of this patent is extended or adjusted under 35 U.S.C. 154(b) by 339 days.

(21) Appl. No.: 12/383,778

(22) Filed: Mar. 27, 2009

(65) Prior Publication Data

US 2010/0242405 A1 Sep. 30, 2010

(51) Int. Cl.
*E04B 1/00* (2006.01)

(52) U.S. Cl. ..... 52/745.13

(58) Field of Classification Search ..... 52/90.1, 52/782.1, 693, 745.13, 745.1
See application file for complete search history.

(56) References Cited

U.S. PATENT DOCUMENTS

| | | | | |
|---|---|---|---|---|
| 2,365,579 | A * | 12/1944 | Mulligan | 52/92.3 |
| 4,370,843 | A * | 2/1983 | Menge | 52/693 |
| 6,240,695 | B1 * | 6/2001 | Karalic et al. | 52/690 |
| 6,460,297 | B1 * | 10/2002 | Bonds et al. | 52/79.1 |
| 6,519,900 | B1 * | 2/2003 | Pierce | 52/66 |
| 6,694,699 | B2 * | 2/2004 | Dowland | 52/741.13 |
| 6,907,695 | B2 * | 6/2005 | Pierce | 52/66 |
| 6,941,718 | B1 * | 9/2005 | diGirolamo et al. | 52/695 |
| 6,988,346 | B2 * | 1/2006 | Shamroukh et al. | 52/693 |
| 7,231,742 | B2 * | 6/2007 | Majlessi | 52/167.3 |
| 7,299,596 | B2 * | 11/2007 | Hildreth | 52/695 |
| 7,509,776 | B2 * | 3/2009 | Reisman | 52/281 |
| 2003/0188508 | A1 * | 10/2003 | Sandoz | 52/782.1 |

* cited by examiner

*Primary Examiner* — Branon Painter

(57) ABSTRACT

A construction method to form a building structure in a post frame bookshelf style.

1 Claim, 3 Drawing Sheets

BOOKSHELF BUILDING PANEL AND METHOD OF CONSTRUCTION

CROSS REFERENCE TO RELATED APPLICATIONS

U.S. Pat. No. 6,988,346 Shamroukh et al.

U.S. Pat. No. 6,694,699 Dowland, Thomas Eugene

STATEMENT REGARDING FEDERALLY SPONSORED RESEARCH OR DEVELOPMENT

Not applicable

REFERENCE TO SEQUENCE LISTING, A TABLE, OR A COMPUTER PROGRAM LISTING COMPACT DISC APPENDIX

Not applicable

BACKGROUND OF THE INVENTION

1. Field of Invention

This invention relates to the construction of post-framed buildings and the methods of erecting a building that ensure a structure's precision and integrity.

2. Prior Art

The traditional process of constructing post frame buildings consists of placing a wooden columnar structure into a hole drilled in the earth or onto a concrete foundation. The column must then be braced and spaced to assure accurate post spacing and plumb alignment. The holes are then filled with soil and compacted to keep the column in place. Dimensional lumber is then used to create a sidewall either by nailing long "girts" to the exterior face of the column or in between the columns to create a cavity to later be filled with insulation and be a framing for interior finishes. This framing method is tedious and requires much checking and rechecking to keep walls plumb and square. It also requires field cutting of lumber, which is more prone to error than framing materials produced in a manufacturing environment. After the wall framing is complete, a prefabricated roof truss is attached to the columns and lumber "purlins" are used to frame the roof. These "purlins" can either be nailed longitudinally on to the top of truss top chord or mounted in between the top chords of the truss using a metal hanger. Much bracing, measuring and labor is required to construct buildings in this manner and often results in imperfections in diaphragm load distribution and framing accuracy.

BRIEF SUMMARY OF THE INVENTION

This new invention solves many of the problems associated with the prior art. The bookshelf building panel is reinforced with high tensile steel cross-bracing to ensure that the panel remains square and true during transport and construction. This strength allows the roof panels, trusses, columns, and wall panels to be assembled on the ground as one unit and raised into place, where it is attached to previously-raised sections, thus completing the wooden structure of the building. This reduces the time needed for construction, assures perfectly square and plumb buildings, and increases safety for workers as most work is done on the ground instead of in the air.

DETAILED DESCRIPTION OF THE INVENTION

Figure 1:
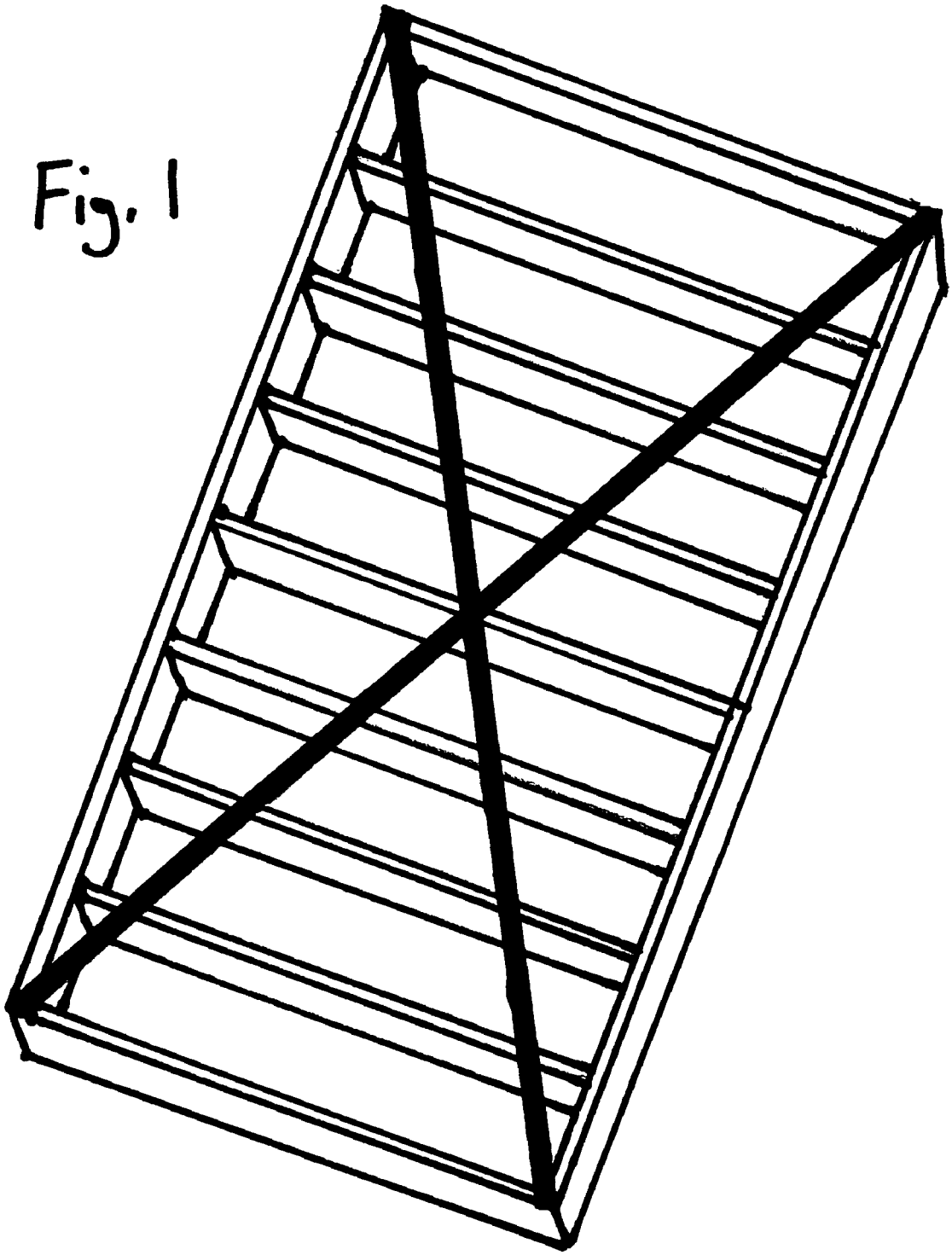
FIG. 1 depicts the bookshelf building panel and the steel strapping cross bracing required to keep it in square and increase the finished building's diaphragm strength.

The description of this invention begins with the building panel itself. The panel in FIG. 1 is designed to fit between the columns of the post frame structure. This method allows for the attainment of high r-values in the resulting building because of the increased area for insulation between the exterior wall and the interior wall. The panel is composed of wooden vertical and horizontal members, mechanically fastened to each other, which may be composed of dimensional lumber from 2×4 to 2×12 depending on the engineering requirements of the building. The most common application would be composed of 2×6 dimensional lumber. Typically the panels would then be 5.5 inches thick. The height of the panel would be the distance from the grade board to the top of the building support columns, and the width of the panel would be the required spacing of the building columns minus the width of the column itself. The panel would also be braced from each corner to its opposite corner with a medium gauge steel strapping in order to keep the panels square during transport and construction and to provide tension bracing to distribute building diaphragm loads. These panels would also be used to compose the roof structure in the same way they are used to compose the sidewall structure. The roof panel application simply requires changing the length and width of the panel to match up with the specific trusses and posts used on any job so that when the wall panel/column/truss/roof panel assembly is constructed they are all the same width. The edge of the roof panel, which matches up with its counterpart at the building peak, would be mitered so that these edges match flush when they are assembled. Multiple combinations of roof panels may be used to obtain any desired length to match the truss top chord length. During assembly their outer edges must be locked together so that they cannot sag when raised into place.

Many customer-demanded options could be included in the panels such as framing for windows and doors, wainscoting for the bottom of wall sections, venting options for roof peaks, and joist hanger reinforcements for the connection of the horizontal and vertical members. Sheathing could also be applied to the panels in the manufacturing process, saving time and labor on the jobsite, reducing waste, and increasing accuracy of the finished product.

The wall panels, wooden support columns, trusses, and roof panels may then be assembled by the following method.

A. The building's exterior walls are laid out and holes for the posts are dug or a concrete foundation is poured.

Figure 2:
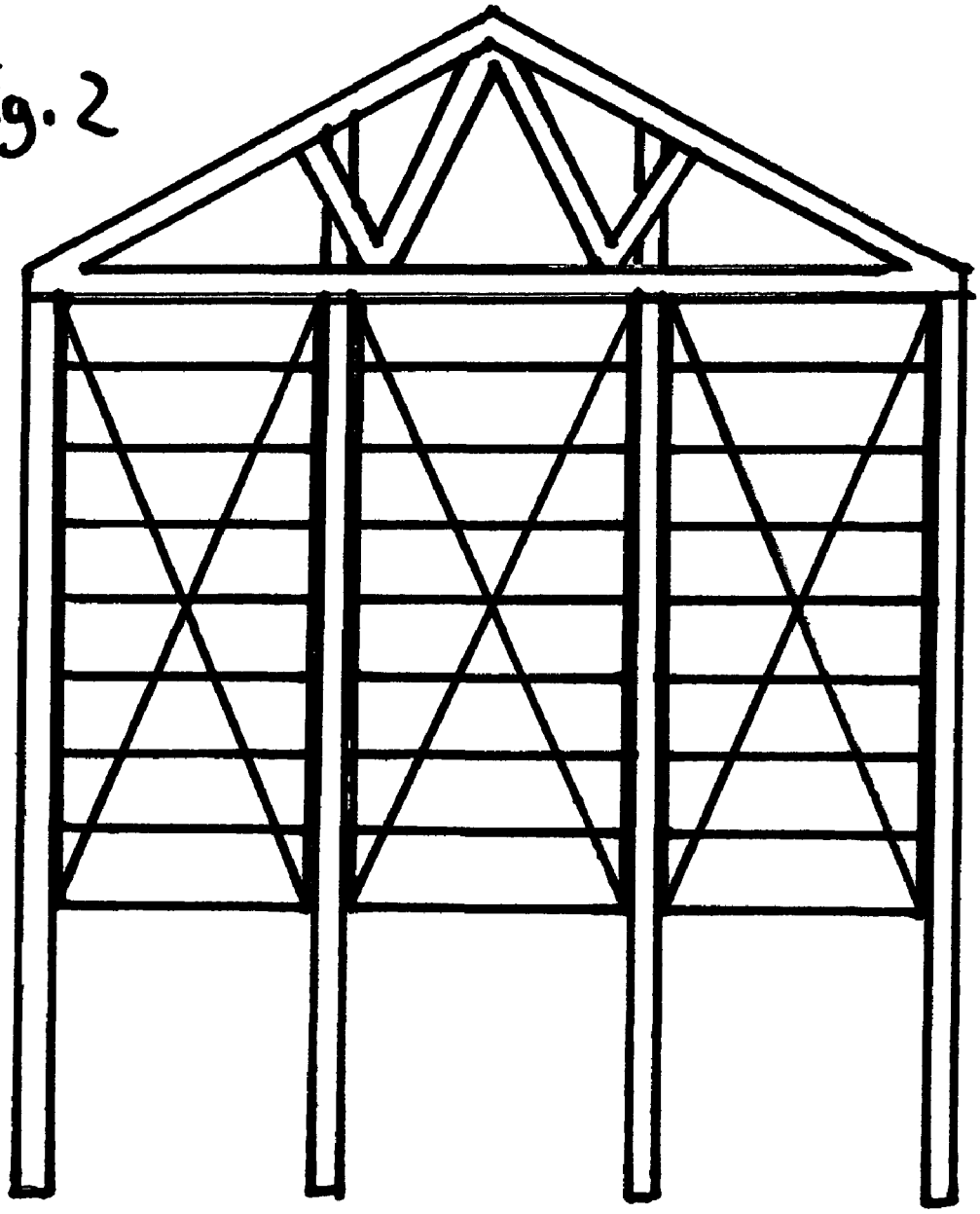
FIG. 2 depicts the gable wall assembly with the wall panels attached to the columns and the gable truss attached to the columns.

B. Starting from one of the gable wall ends, the entire gable wall assembly may be constructed on the ground. Each gable wall panel will be screwed and bolted to the columns and the gable end truss will be mounted to the columns after the columns are notched to accept the thickness of the truss. The bottom of the columns would also be cut to match the elevation of the foundation. The entire gable wall/column/truss assembly (FIG. 2) could then be raised with a crane or other suitable lifting device and lowered into the holes in the earth or onto the concrete foundation. The gable wall-post-truss assembly would then be straightened, plumbed and braced.

Figure 3:
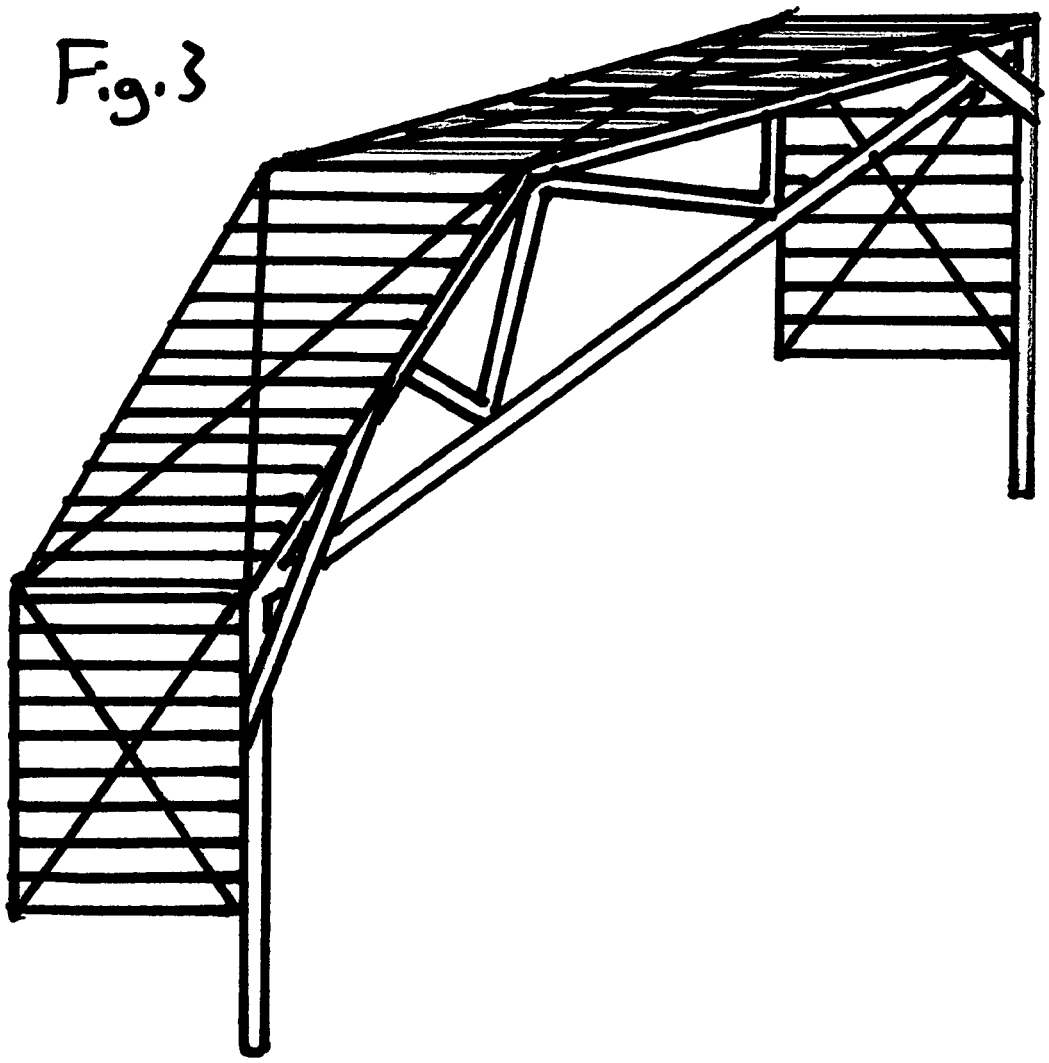
FIG. 3 depicts the wall panel/column/truss/roof panel assembly in the raised position relative to grade.

C. After the gable wall is braced the next truss in order is attached to the next support columns while still on the ground. The bottoms of the columns are cut to length to match the foundation. Wall panels may then be attached to the posts. Roof panels are then attached to the truss and to the wall panel next to it. The roof panels are then attached to each other where they meet in the middle of the truss. Knee braces are added from the column to the truss to keep the column perpendicular to the truss bottom chord during raising. The diagonal steel bracing of the roof and wall panels then allows the entire wall panel/column/truss/roof panel assembly (FIG. 3) to be raised into position without buckling. The assembly is then attached to the gable wall assembly with screws and bolts.

D. The process of step C is repeated until the length of the building is completed, finishing with the opposite gable end wall.

E. Steel siding and roofing or other suitable building materials are then added to complete the structure.

The invention claimed is:

1. A method of construction of a structure utilizing: a prefabricated building wall panel containing two vertical members and a plurality of horizontal members perpendicular to the vertical members, assembled together with mechanical fasteners and steel cross bracing to ensure rigidity, which may or may not include sheathing, which may include framing to accept windows doors or headers, with a minimum thickness of 3.5" to a maximum thickness of 12", to fit between columns of a structure in a bookshelf style; and a prefabricated roofing panel containing two parallel members and a plurality of members perpendicular to the parallel members, assembled with mechanical fasteners, and steel cross bracing to ensure rigidity, which may or may not include sheathing, with a minimum thickness of 3.5" and a maximum thickness of 12", to fit between truss top chords of a structure in a bookshelf style; the method including assembling a gable end wall on the ground with multiple prefabricated wall panels and suitable support columns with a gable end truss and raising the entire gable end wall assembly upon its particular foundation, then straightening, plumbing and bracing the gable wall assembly, laying out on the ground the next truss, attaching the next columns to it, attaching the prefabricated wall panels to each column, attaching the prefabricated roofing panels to the truss, fastening the prefabricated roofing panels to each other where they meet and the prefabricated wall panels to the prefabricated roofing panels where they meet, securing a knee brace from the column to the truss, and raising the entire wall panel/column/truss/roof panel assembly onto the foundation, and attaching it to the gable end wall assembly, continuing in this manner to complete the entire structure, finishing with another gable end wall.

* * * * *